US009707441B2

(12) United States Patent
Yang

(10) Patent No.: US 9,707,441 B2
(45) Date of Patent: Jul. 18, 2017

(54) LIFTING AND FOLDING MECHANISM FOR TREADMILL

(71) Applicant: Ventek Fitness Corporation, Yunlin County (TW)

(72) Inventor: Wen Chang Yang, Taichung (TW)

(73) Assignee: Ventek Fitness Corporation, Yunlin County (TW)

( * ) Notice: Subject to any disclaimer, the term of this patent is extended or adjusted under 35 U.S.C. 154(b) by 0 days.

(21) Appl. No.: 15/054,702

(22) Filed: Feb. 26, 2016

(65) Prior Publication Data

US 2017/0106233 A1 Apr. 20, 2017

(30) Foreign Application Priority Data

Oct. 20, 2015 (TW) ..... 104216739 U

(51) Int. Cl.
*A63B 22/02* (2006.01)
*A63B 24/00* (2006.01)
*A63B 23/035* (2006.01)

(52) U.S. Cl.
CPC ..... *A63B 22/02* (2013.01); *A63B 23/03516* (2013.01); *A63B 24/0087* (2013.01); *A63B 2210/50* (2013.01); *A63B 2210/56* (2013.01)

(58) Field of Classification Search
CPC . A63B 22/02; A63B 22/0235; A63B 2210/50; A63B 22/0023; A63B 24/0087; A63B 23/04; A63B 2225/09; A63B 2225/093
USPC ..... 482/54
See application file for complete search history.

(56) References Cited

U.S. PATENT DOCUMENTS 5,029,801 A * 7/1991 Dalebout ..... A63B 22/0023 248/649
5,372,559 A * 12/1994 Dalebout ..... A63B 22/0023 248/649
7,357,758 B2 * 4/2008 Polk, III ..... A63B 22/0023 482/54
7,381,160 B2 * 6/2008 Lo ..... A63B 22/02 482/51
2005/0037899 A1 * 2/2005 Wu ..... A63B 22/0023 482/54
2005/0096189 A1 * 5/2005 Chen ..... A63B 22/0023 482/54

(Continued)

*Primary Examiner* — Andrew S Lo
(74) *Attorney, Agent, or Firm* — C. G. Mersereau; Nikolai & Mersereau, P.A.

(57) ABSTRACT

A lifting and folding mechanism for treadmill includes a base, a platform, a lifting mechanism, and a linkage mechanism. An armrest rack and a control panel are assembled at the base. A front end of the platform is pivotally assembled with the armrest rack. The lifting mechanism includes a supporting rack and a driving device. One end of the supporting rack is pivotally assembled with the platform, and the driving device is connected between the supporting rack and the platform for driving the supporting rack abutting against the ground, so that the platform is lifted and the slope of the platform is changed. The linkage mechanism is connected to the base and the platform. The linkage mechanism is in a connection state or a disconnection state. In the connection state, the base is connected with the platform, and the base is lifted upward with the lifting of the platform.

5 Claims, 10 Drawing Sheets

(56) References Cited

U.S. PATENT DOCUMENTS

| | | | | |
|---|---|---|---|---|
| 2006/0058160 | A1* | 3/2006 | Lee | A63B 22/0023 482/54 |
| 2008/0070756 | A1* | 3/2008 | Chu | A63B 22/02 482/54 |
| 2008/0312046 | A1* | 12/2008 | Lin | A63B 22/02 482/54 |
| 2009/0176627 | A1* | 7/2009 | Wang | A63B 22/0023 482/54 |
| 2012/0165162 | A1* | 6/2012 | Lu | A63B 22/0235 482/54 |
| 2013/0017929 | A1* | 1/2013 | Hendrickson | A63B 22/0023 482/54 |
| 2013/0123073 | A1* | 5/2013 | Olson | A63B 22/02 482/54 |
| 2013/0237382 | A1* | 9/2013 | Huang | A63B 22/02 482/54 |

* cited by examiner

LIFTING AND FOLDING MECHANISM FOR TREADMILL

BACKGROUND OF THE INVENTION

Field of the Invention

The present invention relates to a treadmill, in particular to a lifting and folding mechanism for treadmill.

Description of the Prior Art

A treadmill has a platform which is motor-driven to rotate, so that a user on the platform can run continuously. The control of the platform (for example, the slope of the platform, the speed of the platform, etc.) is achieved by a control panel. Commonly, the control panel is fixedly assembled at the treadmill along with armrests, and the armrests are fixedly assembled at a base of the treadmill which is standing on the ground. Therefore, when the platform is lifted upward, the position of the control panel is unchanged, and the distance between the user and the control panel is increased. Therefore, it is inconvenient for the user to operate the control panel when the platform is lifted upward.

On the other hand, in addition to the lifting mechanism for adjusting the slope of the platform, the treadmill further comprises a folding mechanism for folding up the platform. Therefore, the whole structure of the treadmill is complicated. Under this arrangement, due to components of the treadmill exist manufacturing tolerances or due to the components of the treadmill are deformed during operation, when the platform is lifted upward or folded up, noises are generated easily, and the treadmill would be damaged easily after a period of time.

SUMMARY OF THE INVENTION

One object of the present invention is to provide a lifting and folding mechanism for treadmill. The armrest rack and the control panel of the treadmill can be lifted upward along with the lifting of the treadmill platform, so that a user can operate the control panel conveniently.

To achieve the above and other objects, a lifting and folding mechanism for treadmill comprises a base, a treadmill platform, a lifting mechanism, and a linkage mechanism. The base comprises an armrest rack assembled at one end thereof. A control panel is assembled at the armrest rack. The treadmill platform comprises a treadmill belt which is motor-driven so as to rotate continuously. A front end of the treadmill platform is pivotally assembled with the base. The lifting mechanism comprises a supporting rack and a driving device. One of two ends of the supporting rack is pivotally assembled with the treadmill platform, and the other end of supporting rack is defined as an abutting end. The driving device is connected between the supporting rack and the treadmill platform. The driving device is for driving the supporting rack to abut against the ground by the abutting end, so that the treadmill platform is lifted and the slope of the treadmill platform is changed. The linkage mechanism comprises a fixing member and a connecting member. The linkage mechanism is connected to the base and the treadmill platform. The linkage mechanism enables the fixing member to connect or disconnect with the connecting member. When the fixing member is connected with the connecting member, the base is lifted upward along with the lifting of the treadmill platform. When the fixing member is disconnected with the connecting member, the base is not lifted upward along with the lifting of the treadmill platform.

In one embodiment, the fixing member is assembled the base. The fixing member has a holder. The holder comprises a receiving space, and a fixing bar is assembled in the receiving space. The connecting member is assembled at the supporting rack. The connecting member is inserted into or leaving the receiving space along with the movement of the supporting rack. When the connecting member is inserted into the receiving space, the connecting member is engaged with the fixing bar. When the connecting bar leaves the receiving space, the connecting member is detached from the fixing bar.

In another embodiment, the fixing member is assembled at the base. The fixing member has a fixing hole. The connecting member is assembled at the treadmill platform. The connecting member comprises a pin which is controllable to be retractable. When the pin is inserted into the fixing hole, the pin is engaged with the fixing hole; when the pin leaves the fixing hole, the pin is disengaged with the fixing hole.

Wherein, a roller is assembled at the abutting end of the supporting rack.

Wherein, the driving device is a power-driven retractable screw. One of two ends of the driving device is pivotally connected with the treadmill platform, and the other end of the driving devices is pivotally connected with the supporting rack.

DETAILED DESCRIPTION OF THE PREFERRED EMBODIMENTS

Figure 1:
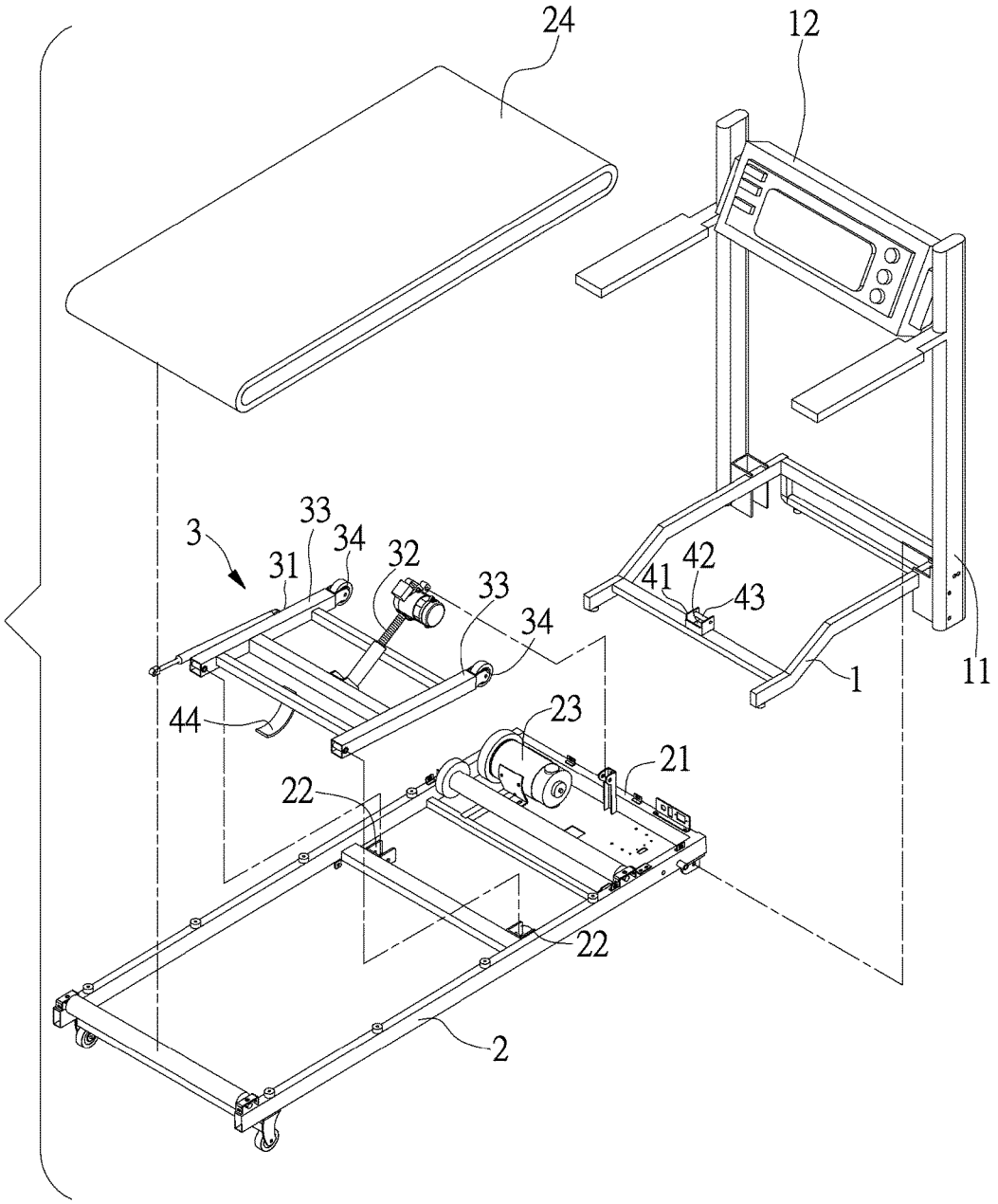
FIG. 1 illustrates an exploded view of a lifting and folding mechanism for treadmill according to a first embodiment of the present invention.

Please refer to FIG. 1, which illustrates a lifting and folding mechanism for treadmill comprising a base 1, a treadmill platform 2, a lifting mechanism 3, and a linkage mechanism. The base 1 comprises an armrest rack 11 stood at one end thereof, and a control panel 12 is assembled at the armrest rack 11. The control panel 12 is for controlling the treadmill. The treadmill platform 2 comprises a treadmill belt 24. The treadmill belt 24 is driven by a motor 23 so as to rotate continuously, so that a user can run on the treadmill belt 24. A front end 21 of the treadmill platform 2 is pivotally assembled with the bottom portion of the armrest rack 11 and capable of being lifted upward by the lifting mechanism 3. Hence, the slope of the treadmill platform 2 can be increased, and the user running on the treadmill platform 2 would take up more efforts.

Figure 2:
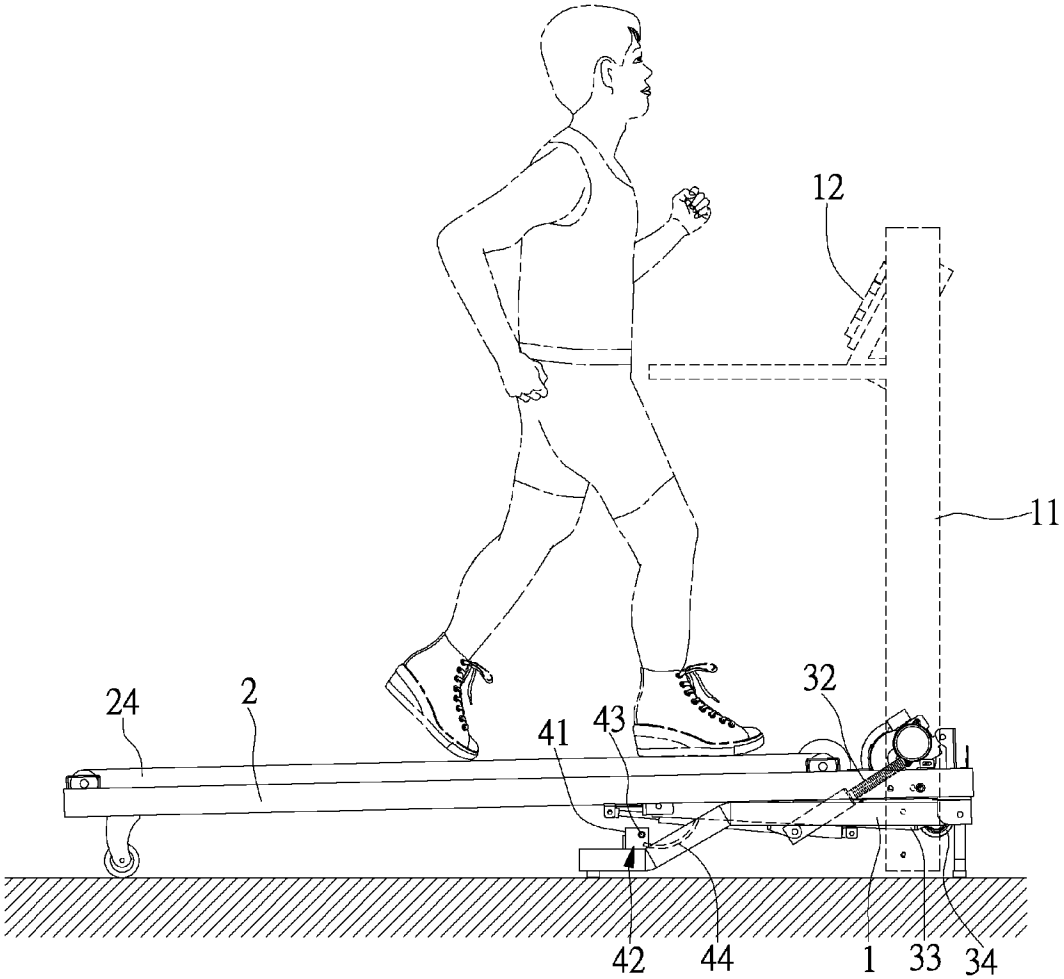
FIGS. 2 to 4 illustrate operational views showing the operation to lift the treadmill platform upward according to the first embodiment of the present invention.
Figure 3:
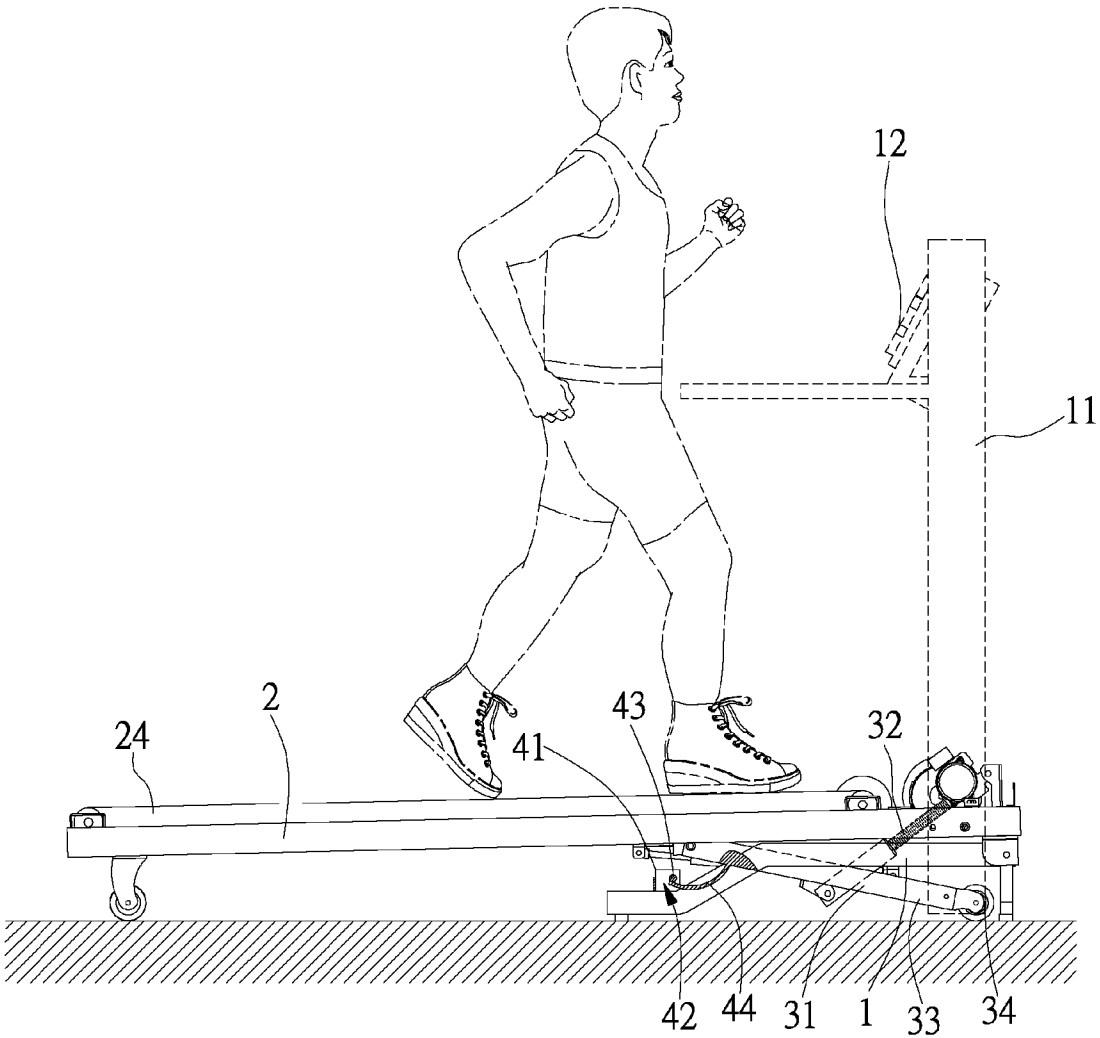
Figure 4:
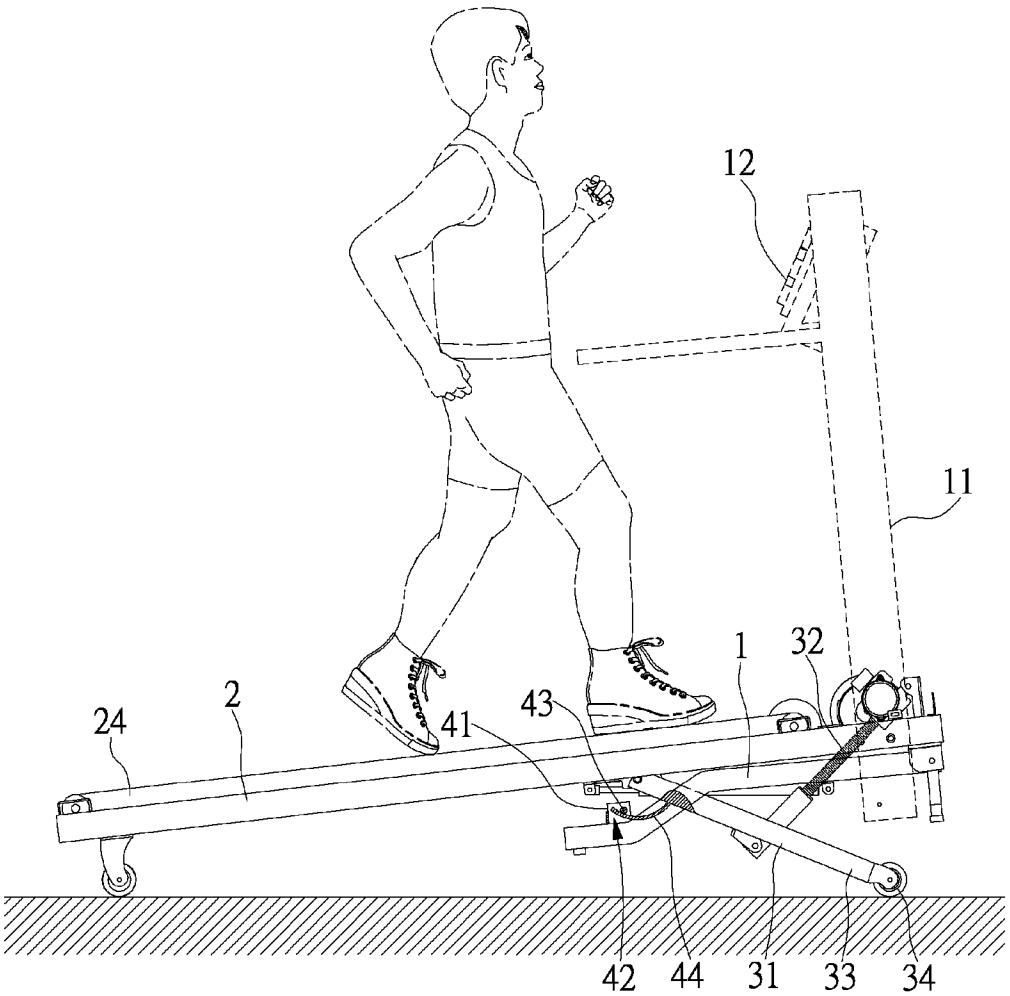

The lifting mechanism 3 comprises a supporting rack 31 and a driving device 32. One of two ends of the supporting rack 31 is pivotally assembled with a pivoting portion 22 of the treadmill platform 2, and the other end of the supporting rack 31 is defined as an abutting end 33 for abutting against the ground. In this embodiment, a roller 34 is assembled at the abutting end 33 for rolling on the ground. The driving device 32 is a power-driven retractable screw, and by rotating the retractable portion of the screw, the retractable portion of the screw is elongated and the length of the screw can be changed. The driving device 32 is assembled between the supporting rack 31 and the treadmill platform 2. In detail, one of two ends of the driving device 32 is pivotally connected with the treadmill platform 2, and the other end of the driving device 32 is pivotally connected with the supporting rack 31. As shown in FIGS. 2 to 4, when the driving device 32 is operated to be elongated, the supporting rack 31 is driven to be pivoted, and the abutting end 33 is abutted against the ground. And then along with the elongation of the driving device 32, the treadmill platform 2 is jacked up by the driving device 32, and the front end 21 of the treadmill platform 2 is lifted upward, so that the slope of the treadmill platform 2 can be changed.

The linkage mechanism is connected to the base 1 and the treadmill platform 2. The linkage mechanism comprises a fixing member and a connecting member. The fixing member is optionally to be connected or disconnected with the connecting member, so that the interaction between the base 1 and the treadmill platform 2 can be changed. In this embodiment, as shown in FIGS. 1 and 2, the fixing member has a holder 41. The holder 41 is assembled at the base 1 and comprises a receiving space 42. A fixing bar 43 is assembled in the receiving space 42, and two ends of the fixing bar 43 are fixed with the holder 41. The connecting member 44 is a curved piece, one end of the connecting member 44 is fixed on the supporting rack 31, and the other end of the connecting member 44 is extended toward the receiving space 42 of the fixing member.

When the driving device 32 is operated to be elongated, as mentioned above, the supporting rack 31 is pivoted and the abutting end 33 is abutted against the ground. Then, as shown in FIG. 3, the connecting member 44 is inserted into the receiving space 42 of the fixing member along with the movement of the supporting rack 31 to engage with the fixing bar 43. Accordingly, the base 1 and the treadmill platform 2 are connected with each other. Next, when the treadmill platform 2 is jacked up and lifted upward, as shown in FIG. 4, the connecting member 44 pushes the fixing bar 43 along with the lifting of the supporting rack 31, so that the base 1 is lifted upward along with the treadmill platform 2, and the armrest rack 11 and the control panel 12 are also lifted upward along with the lifting of the base 1. Hence, after the treadmill platform 2 is lifted upward, the distance between the user and the control panel 12 is still proper for the user to operate the control panel 12 conveniently.

Figure 5:
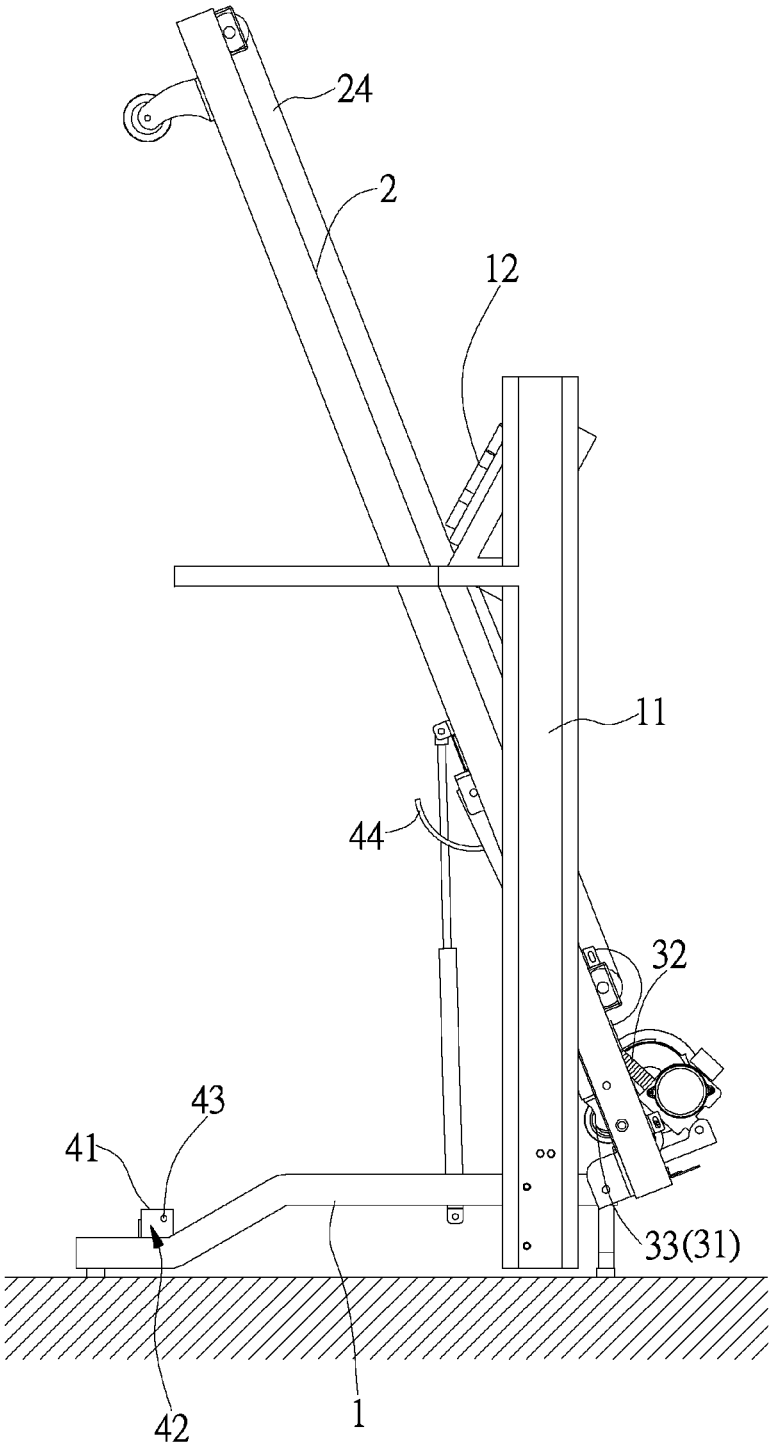
FIG. 5 illustrates a schematic view showing the treadmill platform is folded up according to the first embodiment of the present invention.

On the other hand, to fold up the treadmill platform 2, as shown in FIG. 5, firstly the driving device 32 is operated to be shortened, so that the supporting rack 31 is pivoted again, and the abutting portion 33 is no more abutted against the ground. Then, the connecting member 44 leaves the receiving space 42 along with the movement of the supporting rack 31 and the connecting member 44 is detached from the fixing bar 43. Accordingly, the treadmill platform 2 can be folded up, while the base 1 is not driven by the treadmill platform 2 and locates at its normal position.

Figure 6:
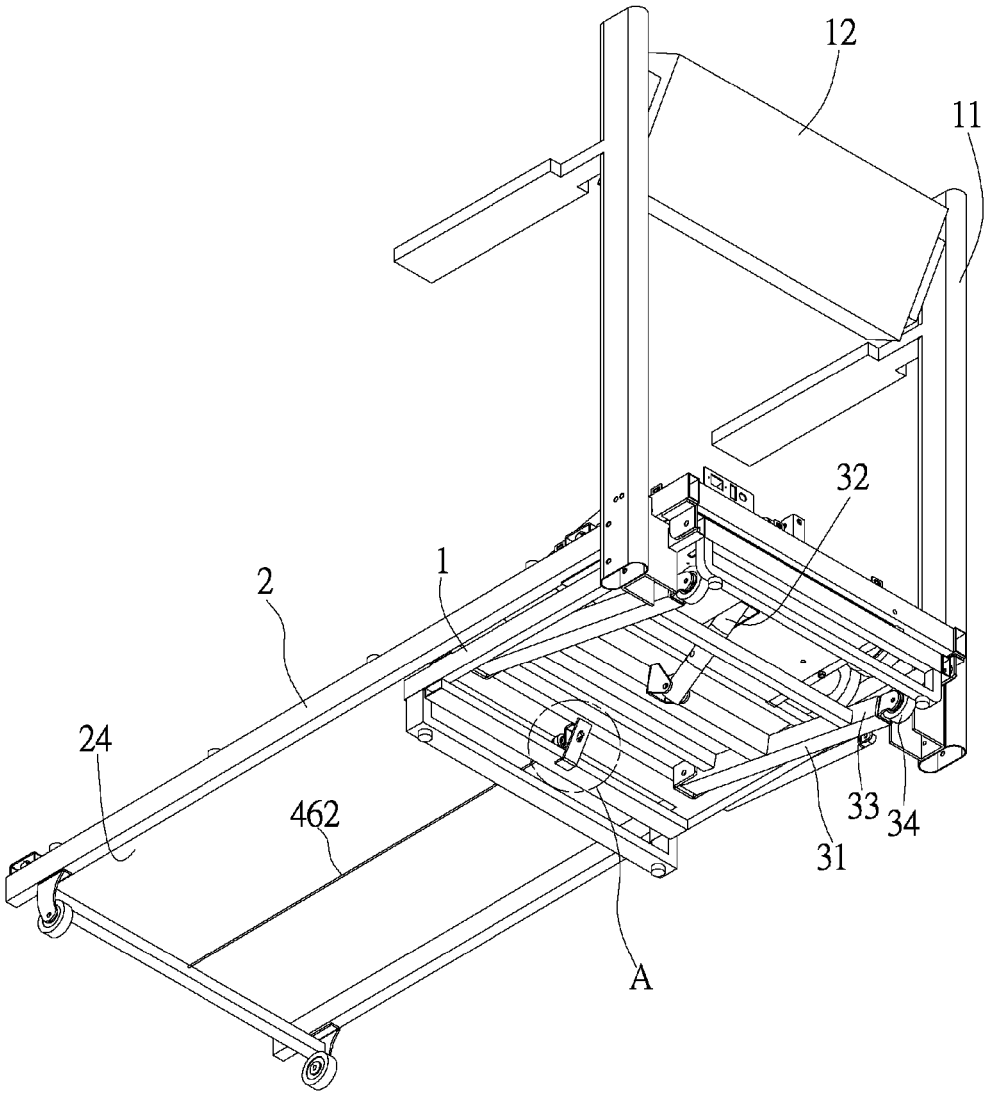
FIG. 6 illustrates a perspective view of a lifting and folding mechanism for treadmill according to a second embodiment of the present invention.
Figure 7:
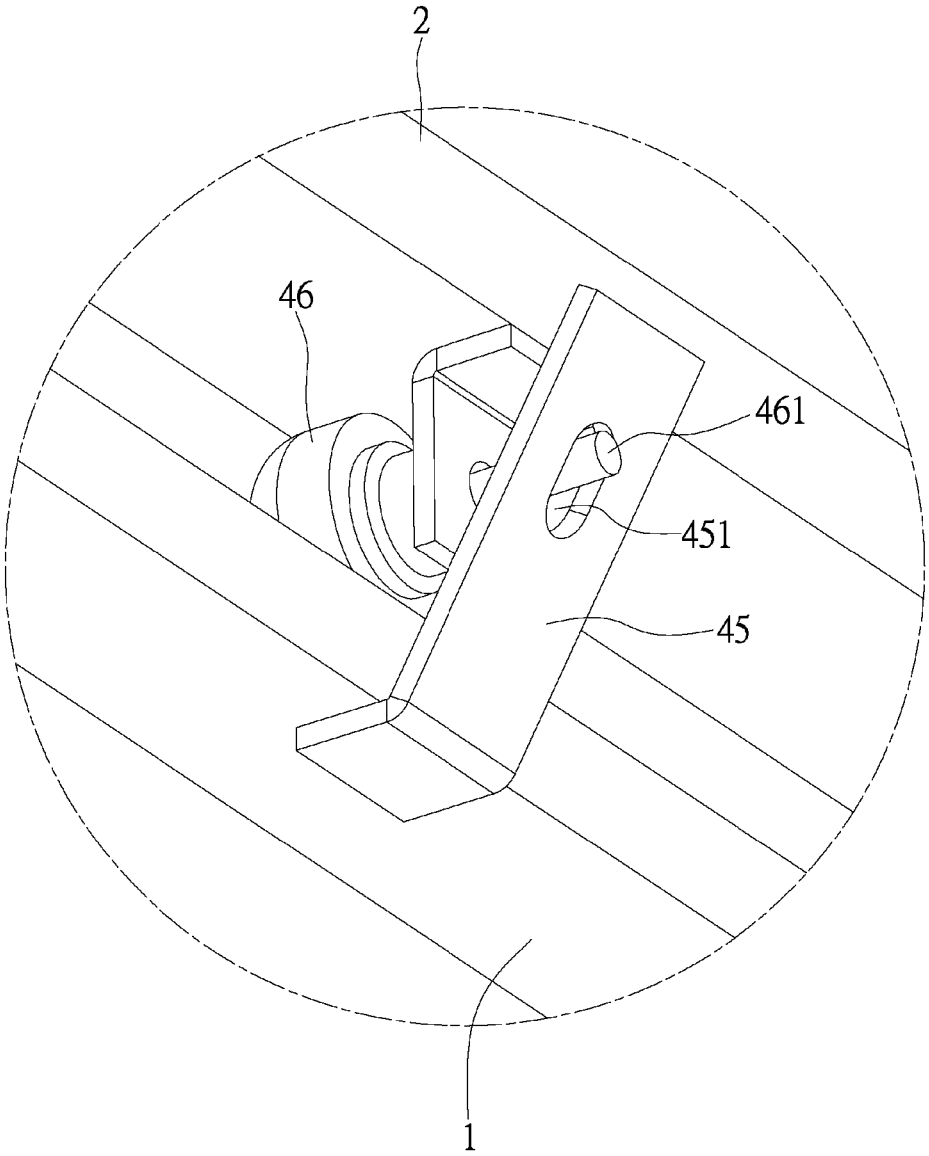
FIGS. 7 and 8 illustrates partial enlarged views of the portion A shown in FIG. 6, and FIGS. 7 and 8 respectively illustrates the operations of the linkage mechanism according to second embodiment of the present invention.
Figure 8:
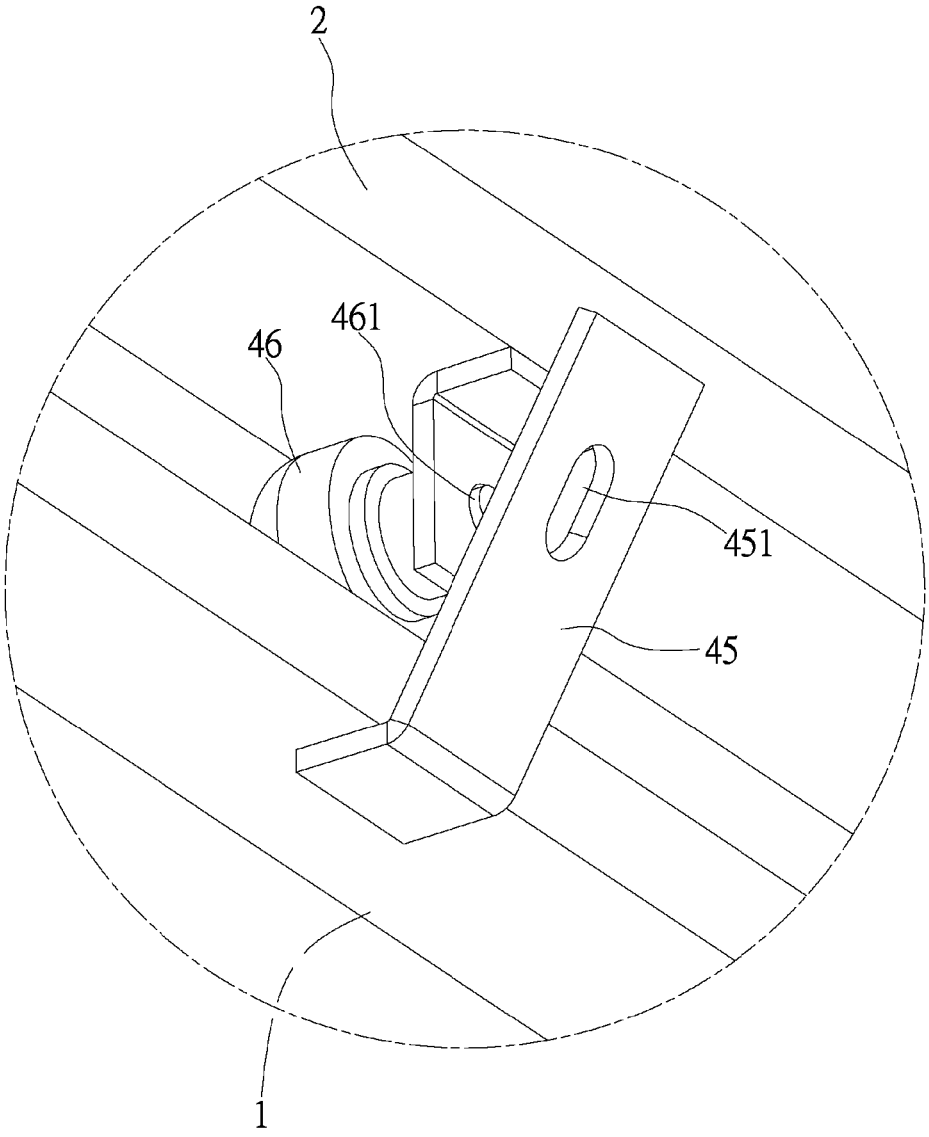
Figure 9:
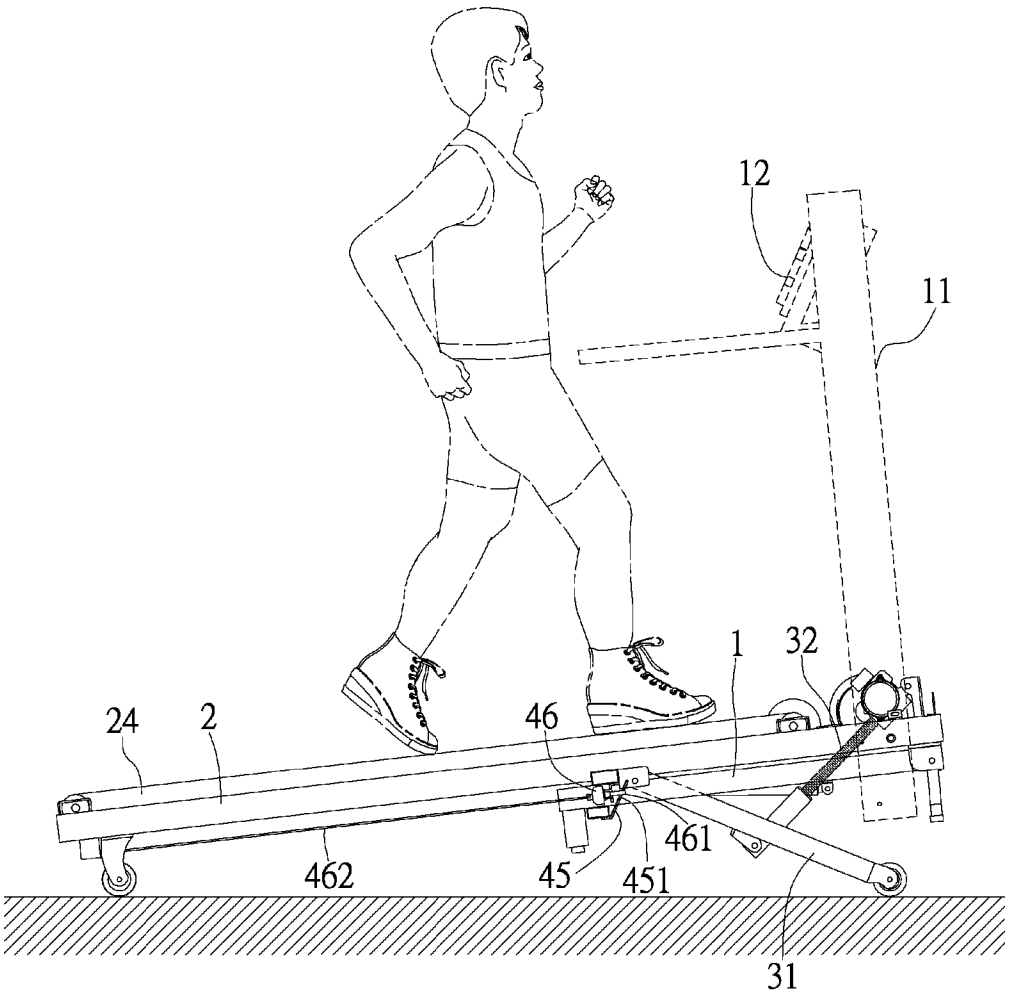
FIG. 9 illustrates a schematic view showing the treadmill platform is lifted upward according to the second embodiment of the present invention.
Figure 10:
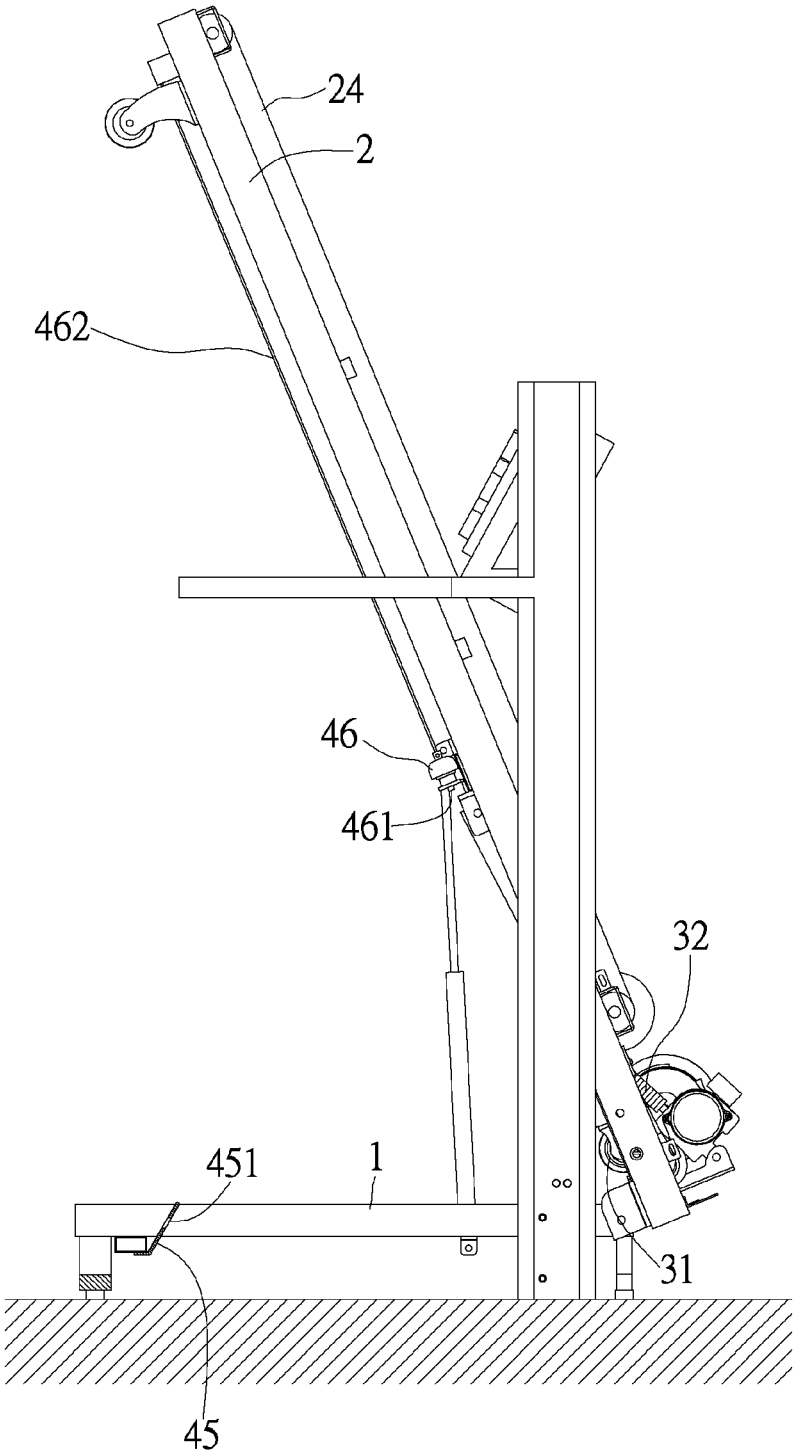
FIG. 10 illustrates a schematic view showing the treadmill platform is folded up according to the second embodiment of the present invention.

FIG. 6 illustrates a second embodiment of the present invention. In the second embodiment, the structure of the linkage mechanism is different from the first embodiment. In this embodiment, as further shown in FIG. 7, the fixing member 45 is assembled at the base 1, and the fixing member 45 has a fixing hole 451. The connecting member 46 is assembled at the treadmill platform 2, and the connecting member 46 comprises a pin 461 which is controllable to be retractable. A string 462 is provided with the connecting member 46 for pulling the pin 461 to control the elongation and retraction of the pin 461. By controlling the elongation and retraction of the pin 461, the pin 461 can insert into the fixing hole 451 and engage with the fixing hole 451, as shown in FIG. 9. Hence, when the treadmill platform 2 is lifted upward, the base 1 is lifted as well. Alternatively, as shown in FIG. 8, in the case that the pin 461 leaves the fixing hole 451, the base 1 is not driven by the treadmill platform 2 and stays at its original position when the treadmill platform 2 is folded up, as shown in FIG. 10.

What is claimed is:

1. A lifting and folding mechanism for treadmill comprising:

a base, comprising an armrest rack assembled at one end thereof, wherein a control panel is assembled at the armrest rack;

a treadmill platform comprising a treadmill belt, wherein the treadmill belt is motor-driven so as to rotate continuously, and a front end of the treadmill platform is pivotally assembled with the base;

a lifting mechanism comprising a supporting rack and a driving device, wherein one of two ends of the supporting rack is pivotally assembled with the treadmill platform, and the other end of the supporting rack is defined as an abutting end, the driving device is connected between the supporting rack and the treadmill platform, the driving device is for driving the supporting rack to abut against the ground by the abutting end, so that the treadmill platform is lifted and a slope of the treadmill platform is changed; and a linkage mechanism comprising a fixing member and a connecting member, wherein the linkage mechanism is connected to the base and the treadmill platform, wherein the linkage mechanism enables the fixing member to connect or disconnect with the connecting member, when the fixing member is connected with the connecting member, the base is lifted upward along with the lifting of the treadmill platform, when the fixing member is disconnected with the connecting member, the base is not lifted upward along with the lifting of the treadmill platform.

2. The lifting and folding mechanism for treadmill according to claim 1, wherein the fixing member is assembled at the base, the fixing member has a holder, the holder comprises a receiving space and a fixing bar is assembled in the receiving space, the connecting member is assembled at the supporting rack, the connecting member is inserted into or leaving the receiving space along with the movement of the supporting rack, wherein when the connecting member is inserted into the receiving space, the connecting member is engaged with the fixing bar, when the connecting bar leaves the receiving space, the connecting member is detached from the fixing bar.

3. The lifting and folding mechanism for treadmill according to claim 1, wherein the fixing member is assembled at the base, the fixing member has a fixing hole, and wherein the connecting member is assembled at the treadmill platform, the connecting member comprises a pin which is controllable to be retractable, and wherein when the pin is inserted into the fixing hole, the pin is engaged with the fixing hole, when the pin leaves the fixing hole, the pin is disengaged with the fixing hole.

4. The lifting and folding mechanism for treadmill according to claim 1, wherein a roller is assembled at the abutting end of the supporting rack.

5. The lifting and folding mechanism for treadmill according to claim 1, wherein the driving device is a power-driven retractable screw, one of two ends of the driving device is pivotally connected with the treadmill platform, and the other end of the driving device is pivotally connected with the supporting rack.

* * * * *